US006644487B2

(12) United States Patent
Smith et al.

(10) Patent No.: US 6,644,487 B2
(45) Date of Patent: Nov. 11, 2003

(54) TAMPER-EVIDENT CLOSURE WITH BREAK-OFF PIECE RETENTION

(75) Inventors: Kelly A. Smith, Milwaukee, WI (US); Walter W. Peterson, Littleton, CO (US); Joseph W. Stanizewski, Rockeford, IL (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/932,774

(22) Filed: Aug. 17, 2001

(65) Prior Publication Data

US 2003/0034323 A1 Feb. 20, 2003

(51) Int. Cl.[7] ..... B65D 41/34

(52) U.S. Cl. ..... 215/235; 215/237; 215/253; 220/840; 220/703; 222/541.5; 222/541.6; 222/556

(58) Field of Search ..... 222/541.1, 541.5, 222/541.6, 556, 153.09; 215/235, 237, 252, 253, 901, 258; 220/836, 840, 847, 703, 255, 256.1

(56) References Cited

U.S. PATENT DOCUMENTS 3,549,053 A * 12/1970 Anderson ..... 222/541.6
3,651,992 A * 3/1972 Hazard ..... 215/237
4,487,324 A 12/1984 Ostrowsky
4,941,592 A 7/1990 Kitterman
4,974,735 A * 12/1990 Newell et al. ..... 215/235
5,282,540 A 2/1994 Beck
5,685,444 A * 11/1997 Valley ..... 215/237
5,735,419 A * 4/1998 Ma ..... 215/253
5,829,611 A * 11/1998 Beck ..... 215/252
5,875,907 A 3/1999 Lay
5,875,942 A * 3/1999 Ohmi et al. ..... 215/237
5,975,369 A 11/1999 Yurkewicz et al.
6,371,316 B1 * 4/2002 Herr et al. ..... 215/204
6,382,476 B1 * 5/2002 Randall et al. ..... 215/237

OTHER PUBLICATIONS

International Search Report for international patent appliation PCT/US02/22362.

* cited by examiner

*Primary Examiner*—Robin A. Hylton
(74) *Attorney, Agent, or Firm*—Wood, Phillips, Katz, Clark & Mortimer

(57) ABSTRACT

A tamper-evident dispensing closure system is provided for a container. The system has a body for extending from the container at the container opening. The body defines a dispensing orifice, a channel, and a retention member projecting over a portion of the channel. The system includes a lid for being moved between a closed position and an open position. An anchor member is provided for being received in the channel and has an engaging portion for engaging the retention member when the anchor member is received in the channel. At least one frangible web initially connects the anchor member with the lid so that the frangible web breaks when the lid is initially lifted from the closed position.

13 Claims, 9 Drawing Sheets

TAMPER-EVIDENT CLOSURE WITH BREAK-OFF PIECE RETENTION

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a fluent material from a container. The invention is particularly suitable for incorporation in a dispensing closure for use with a squeezable container.

BACKGROUND OF THE INVENTION AND TECHNICAL PROBLEMS POSED BY THE PRIOR ART

There are a variety of types of conventional dispensing closures which function generally satisfactorily in applications for which they are designed. One type of prior art dispensing closure system includes a body or base for being attached to the top of a container. The body defines a dispensing orifice. The system further includes a lid which is mounted on the base or body and which can be lifted up to open the dispensing orifice. See, for example, U.S. Pat. No. 4,487,324.

The U.S. Pat. No. 4,487,324 discloses a design which also includes a tamper-evident tear strip for initially preventing lifting of the lid away from the body unless and until the tear strip is first torn away by the user, and this serves as a tamper-evident feature. While such a design offers significant advantages, it would be desirable to provide an improved tamper-evident dispensing closure system.

In particular, it would be advantageous to provide a tamper-evident dispensing closure system which would not require that the user physically pull, and tear away, a component of the assembly. It would also be desirable in such an improved dispensing closure system to have a tamper-evident feature that, upon opening, does not produce a separate, loose piece that must be discarded.

Such an improved tamper-evident dispensing closure system should also be adaptable for use with a one-piece, unitary closure system as well as with a two-piece, or other multiple-piece, closure system.

It would also be beneficial if such an improved tamper-evident dispensing closure system could readily accommodate the connection of the lid to the body with a hinge structure, either a hinge structure that is unitary with both the lid and body, or a two-piece hinge structure that is part of a separately formed lid and separately formed body which can be assembled together.

It would also be advantageous if such an improved tamper-evident dispensing closure system could incorporate the tamper-evident feature in a way which does not hinder access to, or obstruct, the front of the lid where a thumb lift tab might be employed.

It would also be desirable to provide a tamper-evident dispensing closure system which would have a minimum number of components so as to facilitate manufacture and assembly.

It would also be advantageous to provide a dispensing closure system with the capability for accommodating optional tamper-evident features between the container and closure system body that can readily indicate to a consumer that the dispensing closure system has been initially removed from the container.

It would also be beneficial if a dispensing closure system could readily accommodate its manufacture from a variety of different materials.

It would also be advantageous if such an improved closure system could accommodate bottles, containers, or packages which have a variety of shapes and which are constructed from a variety of materials.

Further, it would be desirable if such an improved system could accommodate efficient, high-quality, high-speed, large volume manufacturing techniques with a reduced product reject rate to produce products having consistent operating characteristics unit-to-unit with high reliability.

BRIEF SUMMARY OF THE INVENTION

The present invention provides an improved tamper-evident dispensing closure system for a container that has an opening to the container interior. The system can be readily operated by the user to initially open the system for accommodating flow from the container. The initial opening operation does not produce a separate, loose piece which must be discarded. The tamper-evident closure system can be employed with a one-piece or multi-piece closure body and lid design. Further, the tamper-evident dispensing closure system readily accommodates the employment of the thumb lift tab on the lid and a unitary or multi-piece hinge structure between the lid and the body. The system also accommodates the use of other, optional, tamper-evident features between the closure body and the container.

According to a presently preferred embodiment of the invention, the tamper-evident dispensing closure system includes a body that is adapted to extend from the container at the container opening. The body defines (1) at least one dispensing orifice for communicating with the container opening, (2) a channel, and (3) a retention member projecting over a portion of the channel. The system further includes a lid for accommodating lifting of the lid relative to the body between, (1) a closed position over the body dispensing orifice, and (2) an open position away from the body dispensing orifice. An anchor member is received in the channel and has an engaging portion for engaging the retention member when the anchor member is received in the channel. At least one frangible web initially connects the anchor member with the lid closed and can be broken when the lid is lifted from the closed position.

The closure system can be readily incorporated as a separate assembly of components defining a closure that is separate from, but which is adapted to be mounted to, the container. Such a closure may be incorporated in an embodiment which is removably attachable to the container or which is non-removably attachable to the container. In another contemplated embodiment, the closure body may be formed as an integral or unitary part, or molded extension, of the upper end of a container, and the lid may be provided as a unitary molded extension of the body or may be a separate component.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a dispensing closure system in the typical orientation that it would have at the top of a container when the container is stored upright on its base, and terms such as upper, lower, horizontal, etc., are used with reference to this position. It will be understood, however, that the dispensing closure system of this invention may be manufactured, stored, transported, used, and sold in an orientation other than the position described.

The dispensing closure system of this invention is suitable for use with a variety of conventional or special containers having various designs, the details of which, although not illustrated or described, would be apparent to those having skill in the art and an understanding of such containers. The container per se described herein forms no part of, and therefore is not intended to limit, the present invention. It will also be understood by those of ordinary skill that novel and non-obvious inventive aspects are embodied in the described exemplary closure systems alone.

Figure 1:
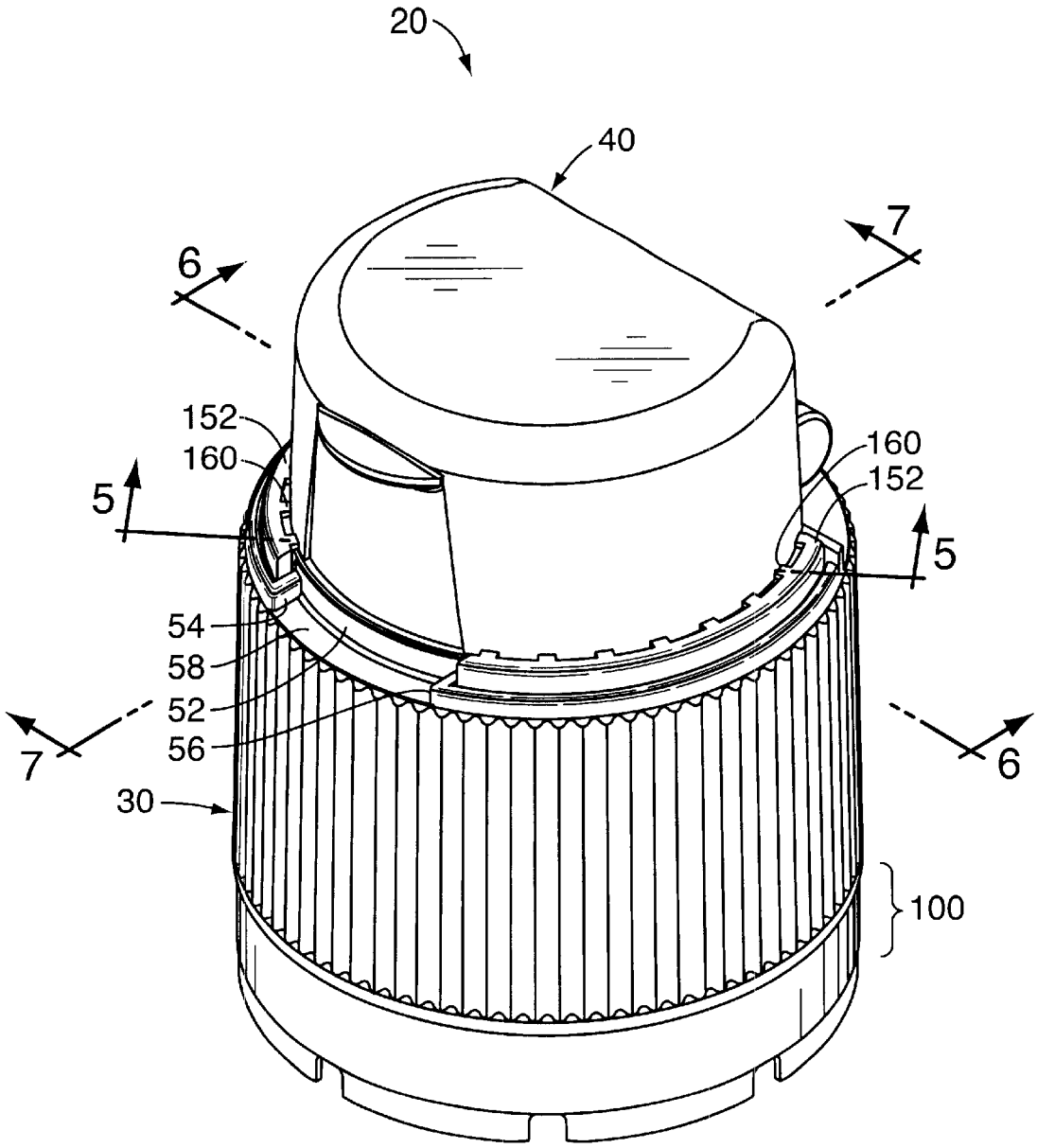
FIG. 1 is a perspective view of an exemplary tamper-evident dispensing closure system in the form of a separate dispensing closure according to a preferred embodiment of the invention, and the closure is shown in a closed configuration, before mounting on a container, and from a vantage point generally above, or from the top of, the closure.
Figure 3:
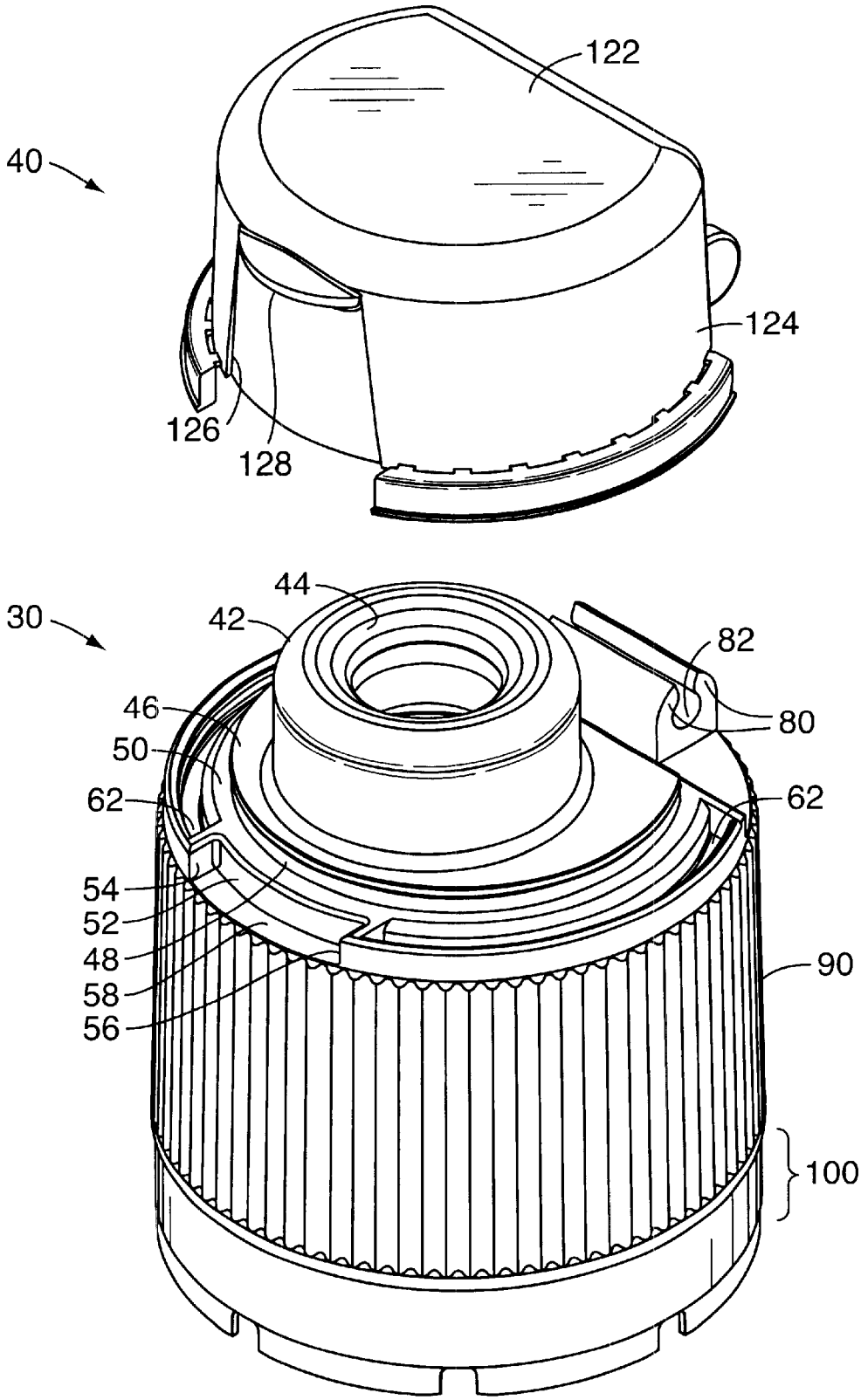
FIG. 3 is an exploded, perspective view of the dispensing closure system prior to the lid being mounted on the body and with the anchor members initially connected by frangible webs to the lid.
Figure 4:
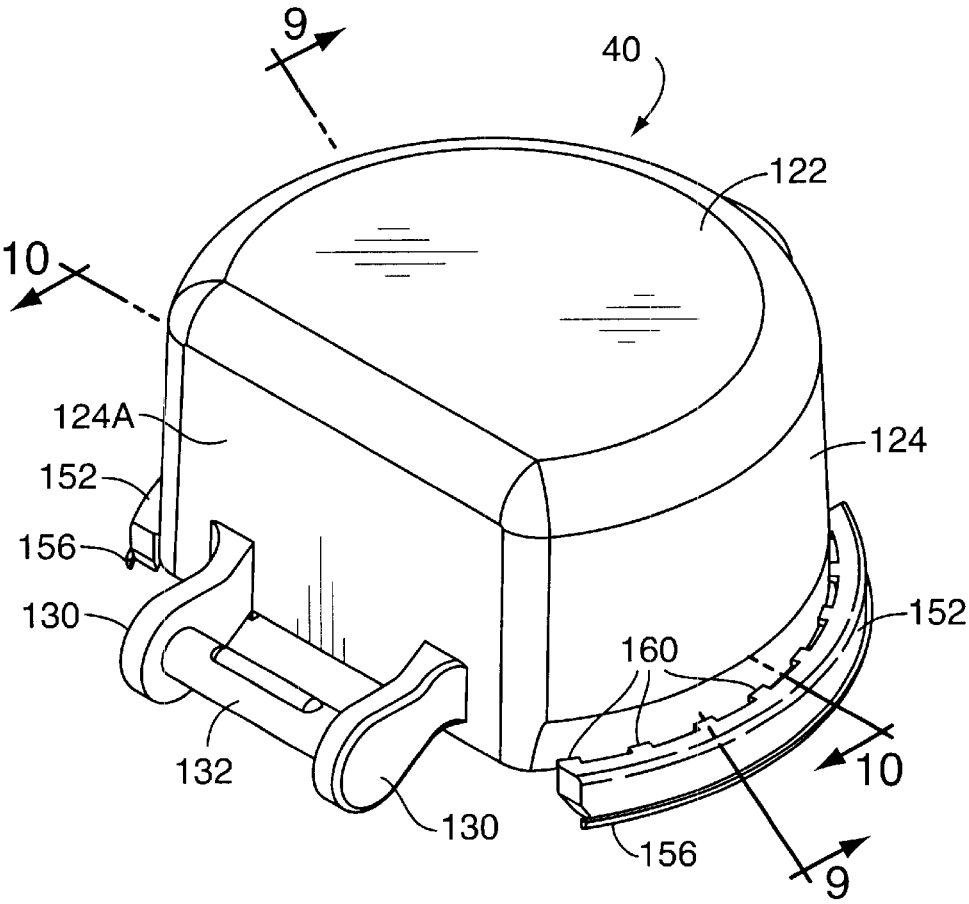
FIG. 4 is a rear, perspective view of the lid illustrated in FIG. 3.
Figure 5:
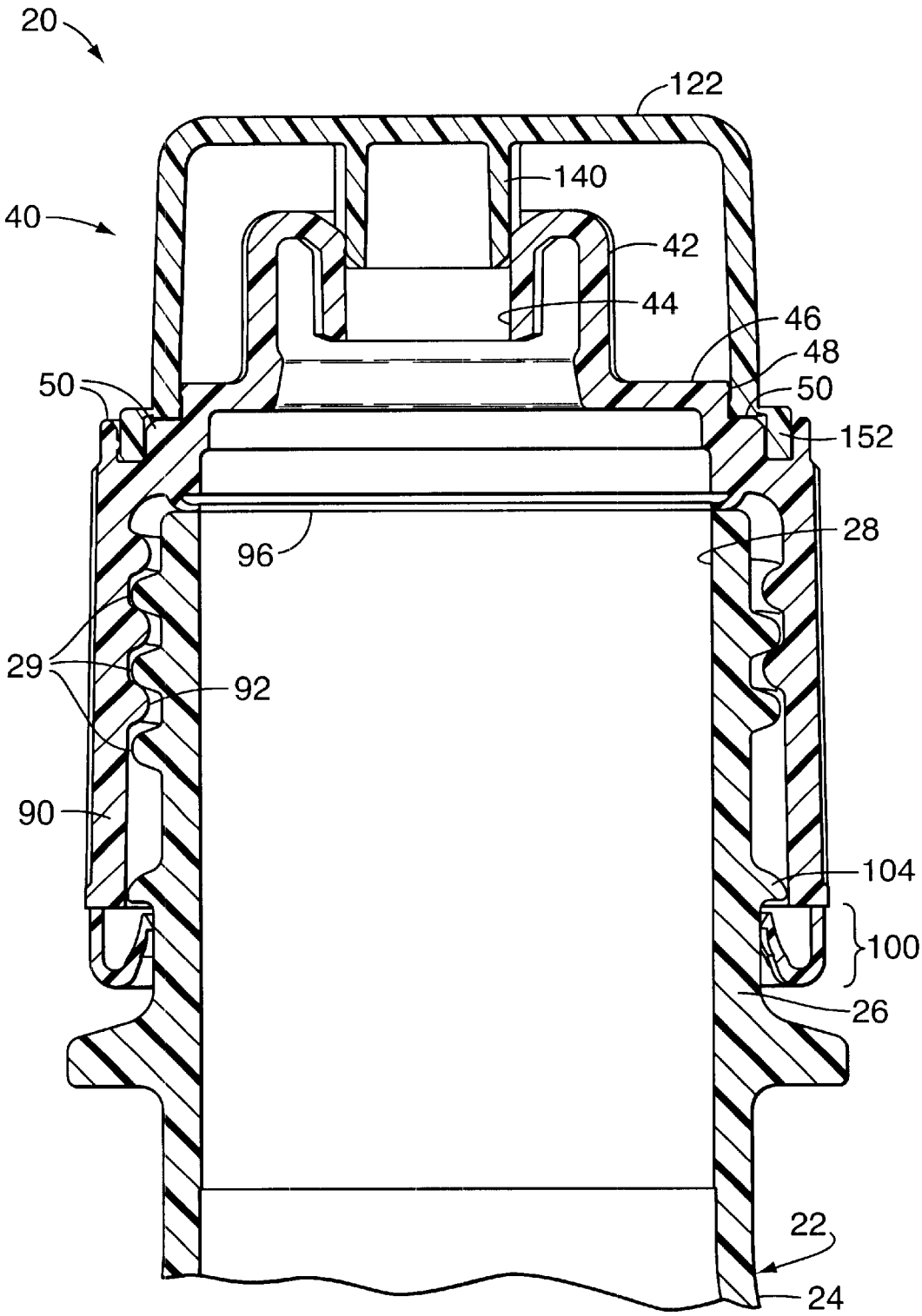
FIG. 5 is an enlarged, fragmentary, cross-sectional view taken generally along the plane 5—5 in FIG. 1, but FIG. 5 also shows the closure mounted on the neck of a container and with the lower tamper-evident band turned upwardly to engage a flange on the container neck.

A presently preferred embodiment of a tamper-evident dispensing structure or dispensing closure system of the present invention is illustrated in FIGS. 1–10 and is designated generally therein by reference number 20 in FIG. 1. In the preferred embodiment illustrated, the dispensing structure or dispensing closure system 20 is provided in the form of a separate closure 20 which is adapted to be mounted on a container 22 (FIG. 5) that would typically contain a fluent material. The container 22 includes body 24 and a neck 26 as shown in FIG. 5. The neck 26 defines an opening 28 to the container interior. The container neck 26, in the preferred embodiment illustrated in FIG. 5, has an external, male thread 29 for engaging the closure 20.

The body 24 of the container 22 may have any suitable configuration, and the upwardly projecting neck 26 may have a different cross-sectional size and/or shape than the container body 24. Alternatively, the container 22 need not have a neck 26 per se. Instead, the container 22 may consist of just a body with an opening. The container 22 may have a rigid wall or walls, or may have a somewhat flexible wall or walls.

Although the container, per se, does not necessarily form a part of the broadest aspects of the present invention, per se, it will be appreciated that at least a body portion of the dispensing structure or system 20 of the present invention may be provided as a unitary portion, or extension, of the top of the container. However, in the preferred embodiment illustrated, the dispensing system 20 is a separate one-piece or multi-piece unit (e.g., a closure) which is adapted to be removably or non-removably mounted to a previously manufactured container 20 which has an opening 28 to the container interior.

The closure 20 is adapted to be used with a container 22 having an opening 28 to provide access to the container interior and to a product contained therein. The closure 20 can be used with many materials, including, but not limited to, relatively low or high viscosity liquids, creams, gels, suspensions, mixtures, lotions, pastes, particulates, granular materials, etc. as constituting a food product, a personal care product, an industrial or household cleaning product, or other compositions of matter (e.g., compositions for use in activities involving manufacturing, commercial or household maintenance, construction, agriculture, etc.).

The container 22 with which the closure 20 may be used would typically be a squeezable container having a flexible wall or walls which can be grasped by the user and squeezed or compressed to increase the internal pressure within the container so as to force the product out of the container and through the closure. Such a flexible container wall typically has sufficient, inherent resiliency so that when the squeezing forces are removed, the container wall returns to its normal, unstressed shape. Such a squeezable wall container is preferred in many applications but may not be necessary or preferred in other applications. For example, in some applications it may be desirable to employ a generally rigid container, and to pressurize the container interior at selected times with a piston or other pressurizing system. Also, the interior of the container need not be pressurized at all. Instead, the product would be accessed by reaching through the open closure with a spoon or straw, or the package could be inverted to let the product discharge through the open closure solely under the influence of gravity.

It is presently contemplated that many applications employing the closure 20 will be most conveniently realized by molding some or all of the components of the closure 20 from suitable thermoplastic material or materials. In the preferred embodiment illustrated, the components of the closure could each be molded from a suitable thermoplastic material, such as polypropylene. The closure components may be separately molded from the same material or from different materials. The materials may have the same or different colors and textures.

Figure 2:
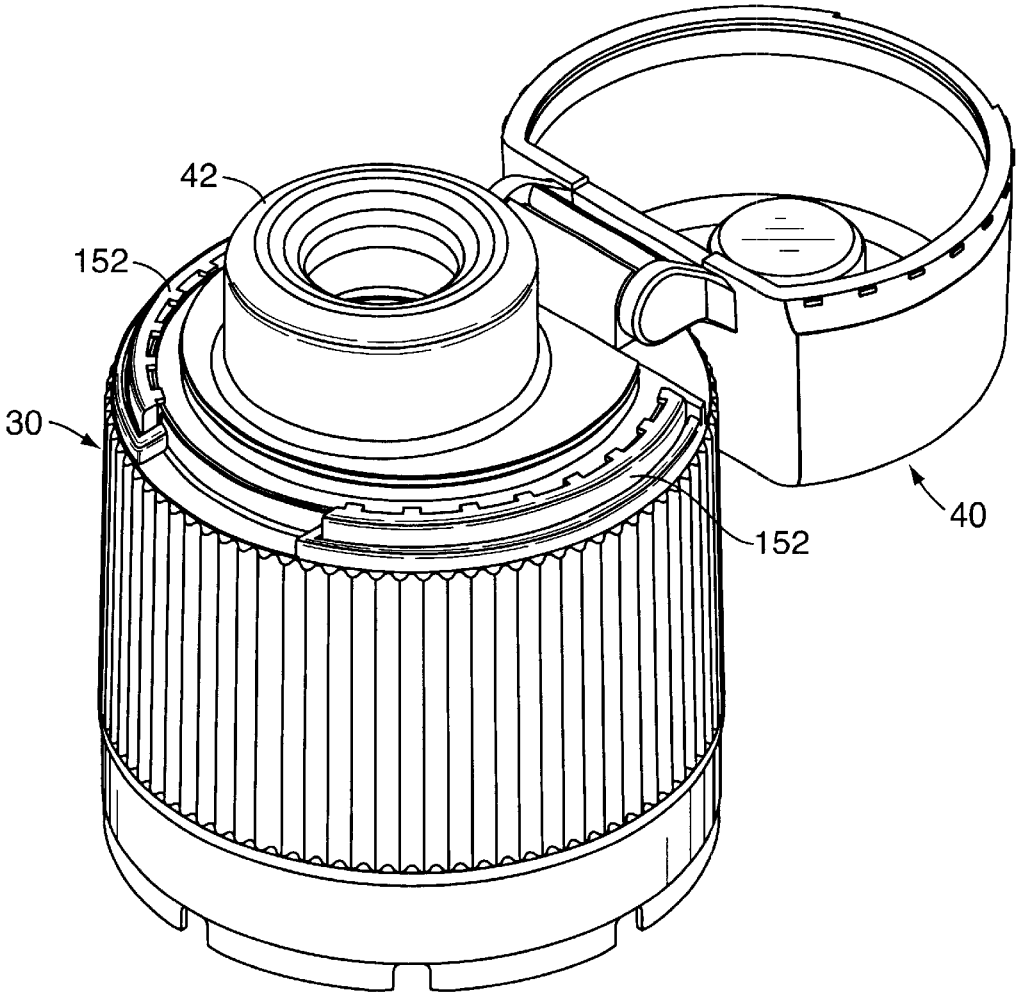
FIG. 2 is a view similar to FIG. 1, but FIG. 2 shows the lid in the open position with the tamper-evident feature having been broken.

As can be seen in FIG. 3, the closure system 20 includes two basic components, (1) a base or body 30, and (2) a lid 40 which is adapted to be carried on the body 30. The lid 40 is movable between a closed position over the body as shown in FIG. 1 and an open position as shown in FIG. 2. The lid 40 may be a separate component which is completely removable from the closure body 30, or the lid 40 may be tethered to the body 30 with a strap, or the lid 40 may be hinged to the body 30 as shown in FIG. 2 so as to accommodate pivoting movement from the closed position to the open position.

As can be seen in FIG. 3, the closure body 30 includes a spout 42 defining a dispensing orifice 44 which opens to the hollow interior of the closure body 30 and which therefore communicates with the opening 28 in the container neck 26 when the closure 20 is mounted on the container 22 as shown in FIG. 5. As shown in FIGS. 3 and 5, at the bottom of the spout 42, the closure body 30 has a peripheral upper deck 46. The peripheral upper deck 46 is defined at its outer edge by a generally vertical wall 48 as can be seen in FIGS. 3 and 5. Surrounding the bottom of the wall 48 is a lower deck 50 as shown in FIGS. 3 and 5.

Figure 7:
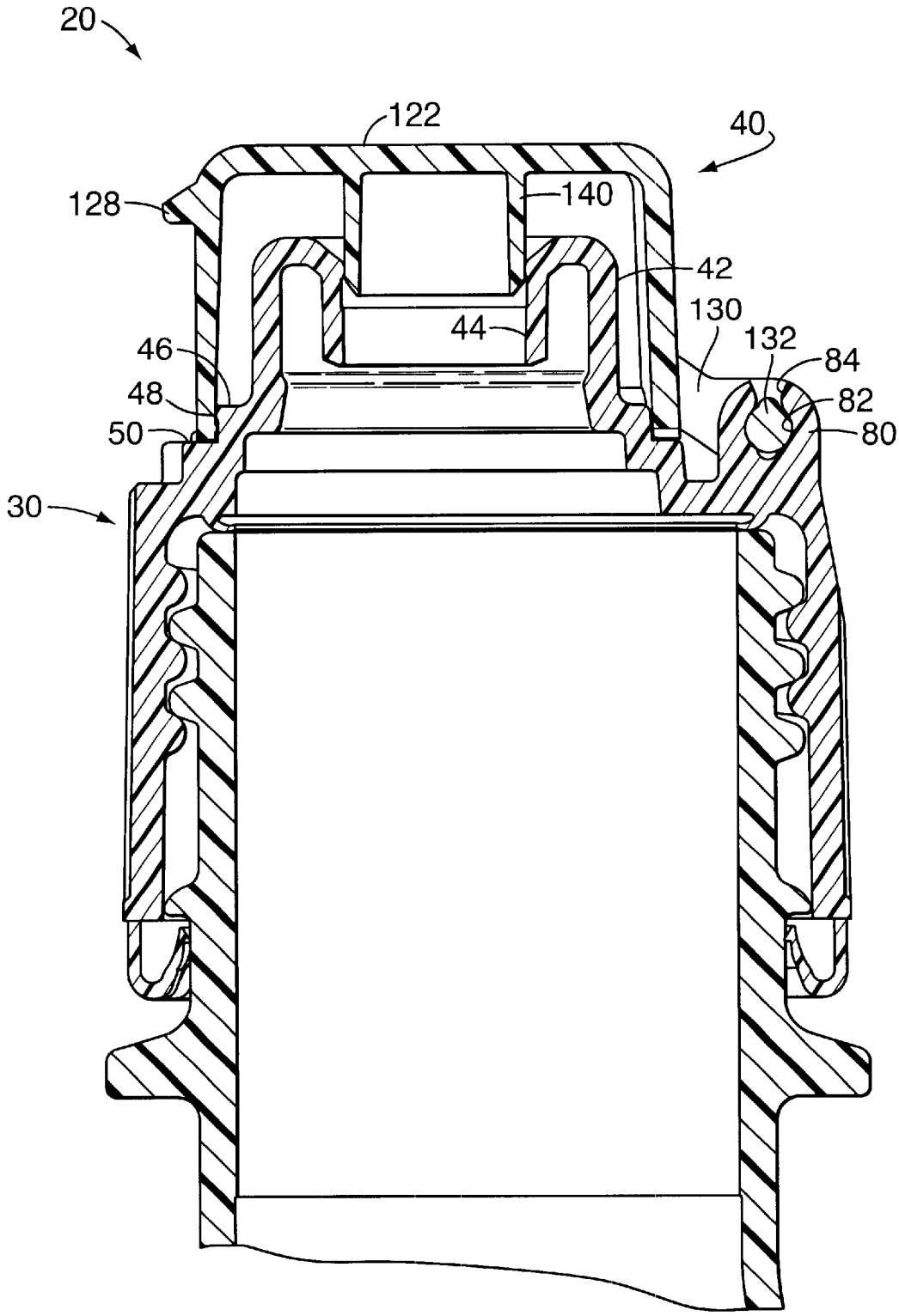
FIG. 7 is an enlarged, fragmentary, cross-sectional view taken generally along the plane 7—7 in FIG. 1, but FIG. 7 shows the closure mounted on the neck of a container and shows the closure body tamper-evident band turned up under the flange on the container neck.

As shown in FIGS. 3 and 7, the front of the closure body 30 has a recess defined by a back wall 52, a left end wall 54, and right end wall 56, and a bottom surface 58.

Figure 8:
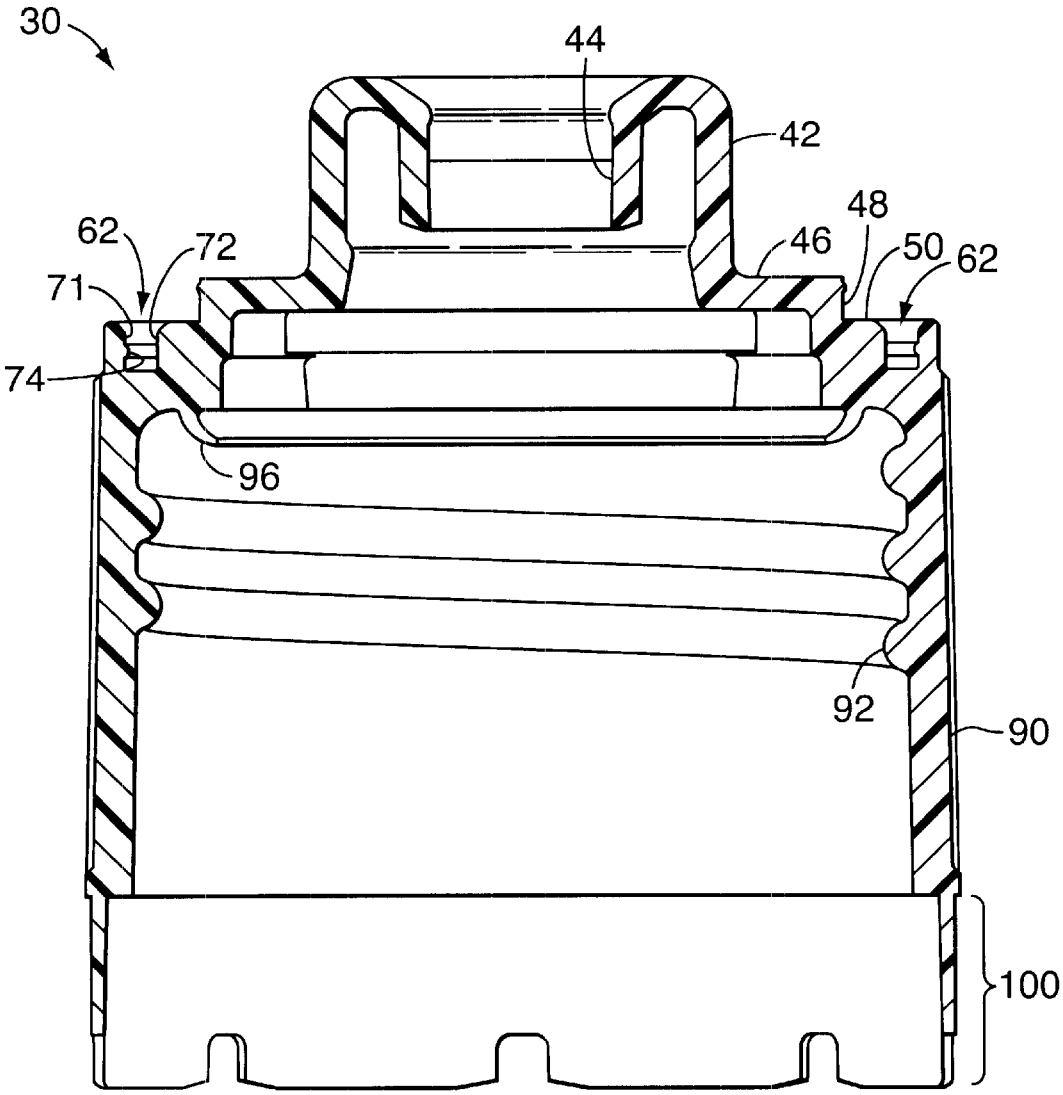
FIG. 8 is a cross-sectional view of the closure body in the as-molded configuration as viewed generally along the plane 8—8 in FIG. 1 but prior to the lid being mounted on the closure body and prior to the closure body being mounted on the container neck.

As shown in FIG. 3, the lower deck 50 includes at least one channel 62, and preferably includes a pair of arcuate channels 62 on either side of the spout 42. As shown in FIG. 8, each channel 62 has a first sidewall 71 and a second sidewall 72. The second sidewall 72 is closer to the dispensing orifice 44 than is the first sidewall 71. A retention member in the form of a bead 74 extends inwardly from the first sidewall 71 toward the second sidewall 72 over a portion of the channel 62. Each channel 62 is open upwardly and extends in an arcuate configuration less than 360° around the dispensing orifice 44.

As can be seen in FIGS. 3 and 7, the rear of the closure body 30 includes a bearing member comprising two, spaced-apart walls 80 which together define between them an upwardly open channel 82. As shown in FIG. 7, the upper, distal end portion of each wall 80 extends toward the other wall 80 over the channel 82 to define a reduced width passage 84 to the channel 82.

As can be seen in FIG. 8, the closure body 30 has an annular skirt 90 extending downwardly form the upper portion of the closure body 30. The interior surface of the skirt 90 defines a female thread 92. As illustrated in FIG. 5, the closure body skirt thread 92 is adapted to threadingly engage the exterior, mail thread 29 on the container neck 26.

Alternatively, the closure skirt 90 could be provided with some other container connecting means, such as a snap-fit bead or groove (not illustrated) in place of the thread 92 for engaging a container neck groove or bead (not illustrated), respectively. The closure body 30 could also be permanently attached to the container 22 by means of induction melting, ultrasonic melting, gluing, or the like, depending on materials used for the closure body 30 and container 22. The closure body 30 could also be formed as a unitary part, or extension, of the container 22.

The closure body skirt 90 may have any suitable configuration for accommodating an upwardly projecting neck 26 or other portion of the container 22 received within the particular configuration of the closure body 30, and the main part of the container 22 may have a different cross-sectional shape than the container neck 26 and closure body 30.

An optional seal or liner (not illustrated) may be sealed across the top of the container neck 26 or, alternatively, to the underside of the upper portion of the closure body 30. However, if a tamper-evident seal or freshness seal as provided by such a liner is not needed or desired in a particular application, then the liner may, of course, be omitted.

Also, if desired, the closure body 30 may be provided with an annular seal 96 (FIG. 5) extending downwardly from the underside of the upper portion of the closure body 30. Such a seal 96 could be "crab's claw" profile seal, as illustrated, or a plug seal, or some other such seal, depending upon the particular application and depending upon whether or not a liner 60 is employed.

In the preferred form of the invention illustrated, the closure body skirt 90 has a generally annular configuration. However, the closure body skirt 90 may have other configurations. For example, the closure body skirt 90 might have a prism or polygon configuration adapted to be mounted to the top of a container neck having a polygon configuration. Such prism or polygon configurations would not accommodate the use of a threaded attachment, but other means of attachment could be provided, such as a snap-fit bead and groove arrangement, or the like.

In one preferred form of the invention as shown in FIG. 5, the closure body 30 incorporates a conventional or special tamper-evident ring 100 along the bottom edge of the closure body 30. As shown in FIG. 8, the tamper-evident ring 100 is initially molded as a downwardly extending unitary flange on the bottom of the closure body skirt 90. Prior to installing the closure body 30 on a container, such as the container 22 illustrated in FIG. 5, the lower half of the tamper-evident ring 100 is deformed radially inwardly so that, as the closure body 30 is threadingly rotated onto the container neck 26, the turned in tamper-evident ring 100 is bent upwardly as it passes over the container neck thread 29 and over a container neck retention flange 104. The turned in portion of the tamper-evident ring 100 snaps inwardly below the container retention flange 104 as shown in FIG. 5. This resists removal of the closure body 30 if a user attempts to rotate the closure body 30 in an unscrewing direction. However, the tamper-evident band or ring 100, in the preferred form, is connected to the bottom end of the closure body skirt 90 by a very thin portion of material (which may have, for example, circumferentially spaced-apart notches or a scored groove or a molded groove (not shown)). If the user attempts to unscrew the closure body 30 with a sufficient amount of torque, then the tamper-evident band 100 will separate from the bottom of the closure body skirt 90. This will serve as an indication that the closure body 30 has been unscrewed, at least partially, from the fully assembled configuration.

The use of a tamper-evident ring or band 100 is an entirely optional feature of the illustrated embodiment, and it does not form a necessary part of the present invention. Indeed, if the closure body 30 is non-releasably attached to the container neck 26 (as with adhesive, thermal bonding, irreversible snap-fit configurations, etc.), then the tamper-evident ring 100 would provide no additional benefit. Similarly, a tamper-evident ring 100 would provide no additional benefit if the closure body 30 were formed as a unitary molded extension of the container neck 26.

As shown in FIG. 3, the lid 40 includes a top wall 122 and a skirt 124. The front of the lid 40 has an indentation 126 in the skirt 124. A thumb lift tab 128 projects outwardly from the top portion of the lid 40 over the recess 126.

As can be seen in FIG. 4, the skirt 124 has a flat wall section 124A at the rear of the lid 40. Projecting outwardly from the flat wall portion 124A is a pair of rearwardly extending lugs 130. A shaft 132 extends between, and connects, the lugs 130 at a location where the shaft 132 is spaced from the lid skirt flat wall portion 124A.

With reference to FIG. 7, the lid shaft 132 is received within the upwardly open channel 82 defined at the rear of the closure body 30. The shaft 132 has a width dimension or diameter that is greater than the opening 84 between the upper, distal ends of the walls 80 which define the sides of the channel 82. This provides a snap-fit engagement and retains the lid shaft 132 on a fixed axis relative to the closure body 30 to accommodate pivoting movement of the lid 40 relative to the closure body 30 between the full closed position (FIG. 1) and the full open position (FIG. 2).

Figure 9:
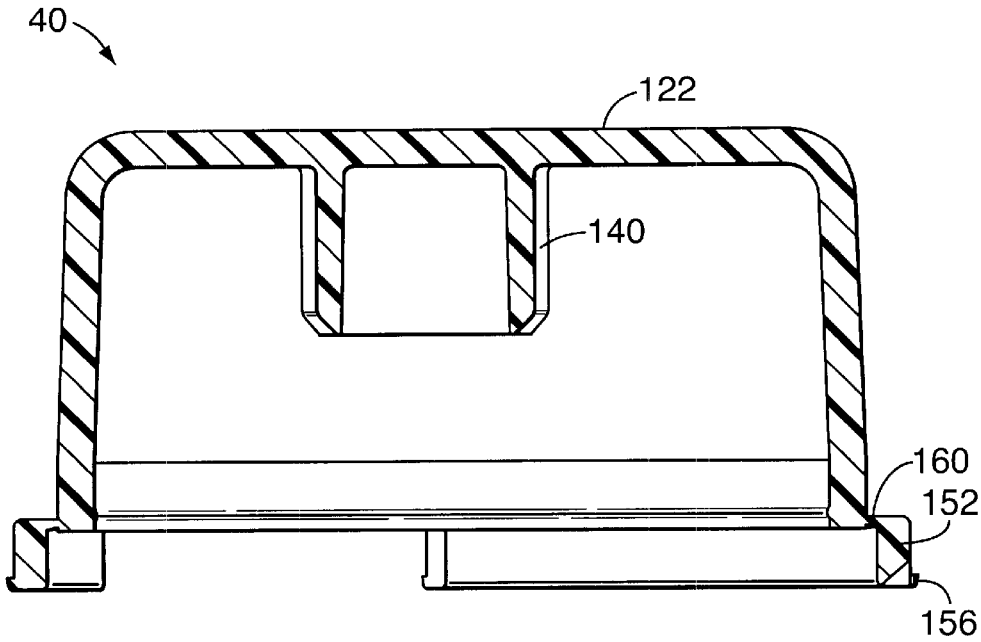
FIG. 9 is a cross-sectional view taken generally along the plane 9—9 in FIG. 4.

As can be seen in FIG. 9, the lid 40 includes a plug or spud 140 projecting downwardly from the underside of the lid top wall 122. As shown in FIGS. 5 and 7, the spud 140 is adapted to be received within the dispensing orifice 44 of the spout 42. In the preferred embodiment illustrated in FIGS. 5 and 7, the dispensing orifice 44 is a substantially cylindrical orifice, and the exterior of the lid plug or spud 140 has a generally cylindrical surface. The diameter of the exterior surface of the lid spud 140 is slightly greater than the internal diameter of the body dispensing orifice 44. This provides an interference fit to effect good sealing engagement. Either the spud 140 or the spout 42, or both, have sufficient flexibility to accommodate such an interference fit providing leak-tight sealing capability.

According to the present invention, a unique tamper-evident feature is provided for indicating that the lid 40 has been initially moved away from the fully closed configuration (FIG. 1). The tamper-evident feature involves cooperation between the lid 40 and closure body 30. As shown in FIG. 4, the tamper-evident feature includes at least one anchor member 152 which is initially connected to the lid 40. In the preferred embodiment, where the closure body 30 includes two channels 62, there are two anchor members 152 provided on either side of the lid 40 along the bottom edge of the lid 40. Each anchor member 152 is a generally arcuate strip which includes an engaging portion in the form of a lip 156 extending outwardly at the bottom of the anchor member (see FIG. 10).

The tamper-evident feature also includes at least one frangible web 160 (FIG. 4) which initially connects one of the anchor members 152 with the lid 40. In the preferred embodiment illustrated in FIG. 4, there are a plurality of frangible webs 160 in the form of spaced-apart bridges extending between an anchor member 152 and the lid skirt 124. The webs 160 are initially molded together as a unitary structure with the lid 40 and anchor members 152.

In the presently contemplated preferred form of the invention, the manufacturer can readily mold the lid 40, webs 160, and anchor members 152 together as a single, unitary component, and can separately mold the closure body 30 as another separate component. The lid 40 and body 30 may be molded from the same thermoplastic material or from different thermoplastic materials. The lid 40 and body 30 may have the same color and texture or may have different colors and/or textures.

After separately molding the lid 40 and closure body 30, the two components are assembled by mounting the lid 40 on the closure body 30 so that the lid hinge shaft 132 is received in a snap-fit engagement within the closure body receiving channel 82. The assembled closure 20 may then be shipped to an entity that fills bottles or other containers with a fluent product and then installs the closures 20 on the filled containers.

Figure 6:
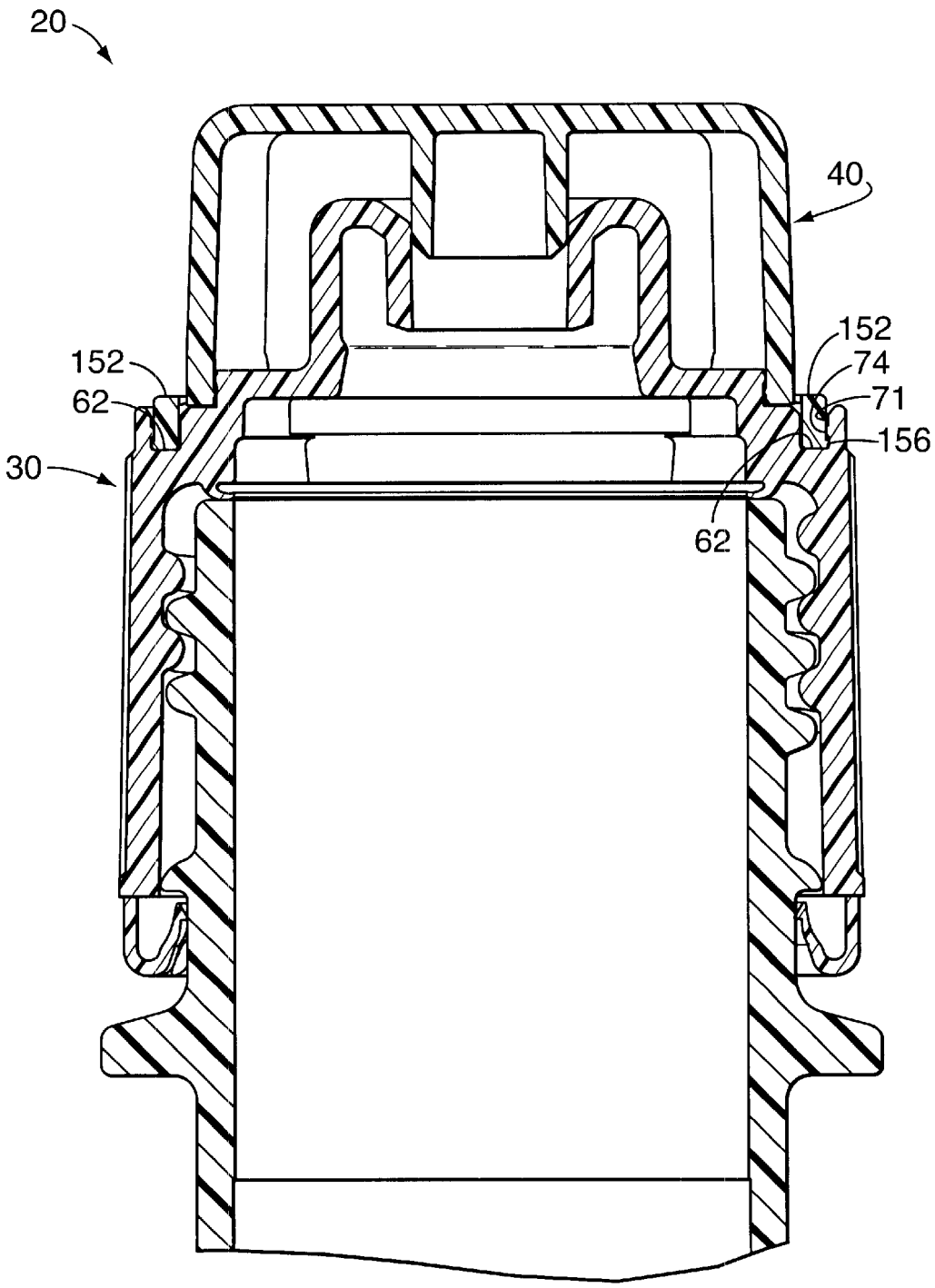
FIG. 6 is an enlarged, fragmentary, cross-sectional view taken generally along the plane 6—6 in FIG. 1, but FIG. 1 shows the closure mounted on the neck of a container with the tamper-evident band turned up under a flange on the container neck.
Figure 10:
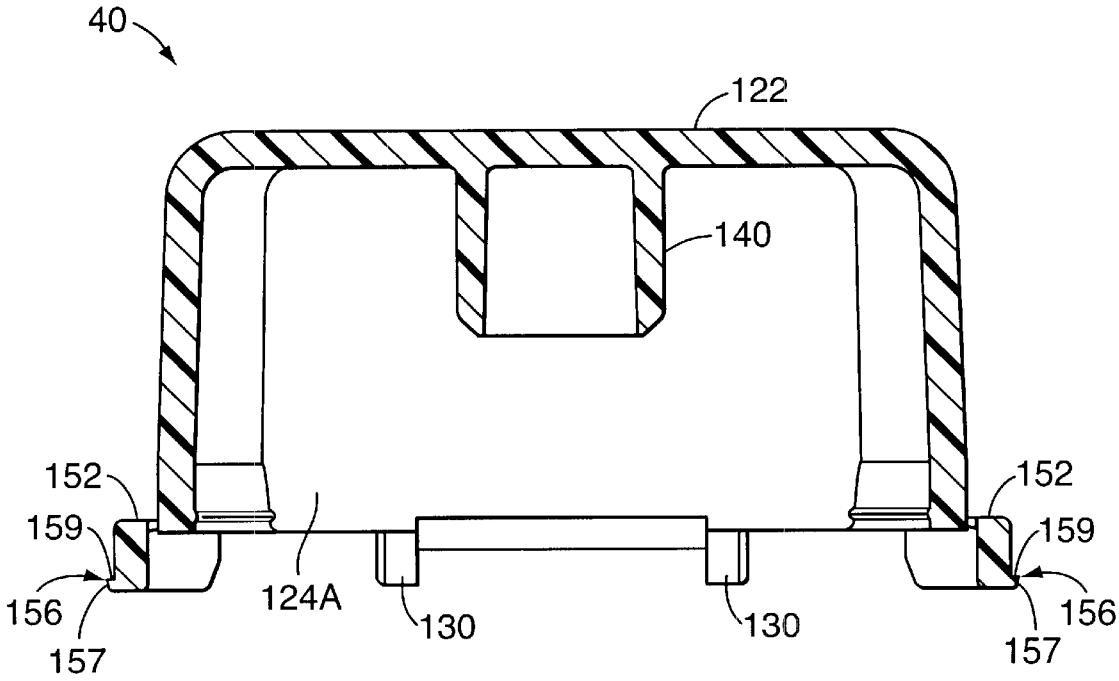
FIG. 10 is a cross-sectional view taken generally along the plane 10—10 in FIG. 4.

As the lid 40 is properly mounted on the closure body 30, the anchor members 152 are received within the closure body channels 62 as illustrated in FIG. 6. Each anchor member lip 156 is forced past, and below, the adjacent channel retention bead 74 as shown in FIG. 6. The channel first sidewall 71 has sufficient flexibility to accommodate the movement of the anchor member lip 156 past the sidewall retention bead 74. As shown in FIG. 10, the anchor member lip 156 has an inwardly slanting or tapered leading surface 157 and a generally flat shoulder surface 159 at the upper, trailing end of the tapered surface 157. The tapered surface 157 accommodates the movement of the anchor member lip 156 to the position below the closure body retention bead 74 on the first sidewall 71 as shown in FIG. 6. However, the configuration of the anchor member shoulder surface 159 (FIG. 10) provides substantially no outward transfer of force to the closure body channel first sidewall 71 when the lid 40 is lifted upwardly. Thus, if an upward lifting force is applied to the lid 40, it is not possible to develop enough force directed outwardly on the closure body first sidewall 71 to move the sidewall 71 radially outwardly enough to disengage the anchor member lip 156 before the frangible webs 160 break. Than is, the frangible webs 160 are designed to break up on the application of a upward lifting force to the lid 40 which is less than a force that would be required to pull the anchor member lip 156 past the sidewall retention bead 74.

The closure 20 need not be made in two or more separate parts. For example, if desired, the entire closure 20 could be molded as a single, unitary structure with an integral hinge system such as a snap-action hinge, tether hinge, or the like. The detailed design of such a hinge system forms no part of the present invention. Indeed, the present invention contemplates that the lid 40 and closure body 30 could be provided as separate components without any hinge structure so that the lid would not remain attached to the closure body after the assembly is opened.

The user can readily open the closure 20 by merely lifting the lid 40 upwardly This is facilitated by the lid thumb lift 128 which can be pushed upwardly by the user. When a sufficient upward force is applied to the lid 40 by the user, the frangible webs 160 break. The anchor members 152 remain in the closure body channels 62 because the anchor member lips 156 are retained under the channel retention beads 74. Thus, the initial opening of the lid 40 does not produce any loose, separate pieces which must be discarded. Further, when the lid 40 is returned to the closed configuration, the user can observe that the frangible webs 160 have been broken. This serves as an indication that the lid 40 may have been opened, or at least that the closure 20 was tampered with.

When the closure 20 is in the full open condition as shown in FIG. 2, the user can tip or invert the package to facilitate the dispensing of fluent product under the influence of gravity. If the container 22 has a flexible wall or walls, the container 22 can be squeezed to further assist in dispensing the product.

After the desired amount of product has been dispensed, the package can be turned back to its upright orientation, and the user can close the lid 40.

It will also be appreciated that the dispensing system of the present invention need not be provided as a separate closure for a container. The closure body 30 could instead be molded as a unitary part of the container 22. A container could be molded to have (1) an initially open bottom end, (2) a peripheral wall forming an upper end that defines a container top end opening, and (3) a unitary closure body portion extending radially inwardly from the container peripheral wall over the container top end opening so as to form a unitary part of the container top end and so as to define a unitary, top end closure body, including the spout 42 (and optionally including a hinge and lid, if the body, hinge, and lid are to be part of a single, unitary structure). Then, the container could be filled with product through the open bottom end, and the open bottom end could be subsequently sealed closed by appropriate means, such as with thermally assisted deformation or with a separate bottom closure plug or cap.

It will also be appreciated that the dispensing system of the present invention may include other components, elements, or features. For example, the closure body 30 (FIG. 3) could include an internal valve system. The valve could be, for example, a pressure-actuated, flexible, resilient slit valve. Such a valve has the configuration and operating characteristics of a commercially available valve design substantially as disclosed in the U.S. Pat. No. 5,676,289 with reference to the valve 46 disclosed in the U.S. Pat. No. 5,676,289. The operation of such a type of valve is further described with reference to the similar valve that is designated by reference number 3*d* in the U.S. Pat. No. 5,409,144. The descriptions of those patents are incorporated herein by reference thereto to the extent pertinent and to the extent not inconsistent herewith. The embodiment of the present invention shown in FIG. 8 herein could accommodate such a valve within the closure body spout under the dispensing orifice 44. Such a valve could be held in place with a suitable retainer ring in snap-fit engagement with the closure body. Alternatively, such a valve could be secured with other means, such as bi-injection molding, adhesive securement, or the like.

It will be readily apparent from the foregoing detailed description of the invention and from the illustrations thereof that numerous variations and modifications may be effected without departing from the true spirit and scope of the novel concepts or principles of this invention.

What is claimed is:

1. A tamper-evident dispensing closure system for a container that has an opening to the container interior, said dispensing closure system comprising:

a body capable of extending from said container at said opening as either a separate structure or as a unitaxy extension of said container, said body having (1) at least one dispensing orifice for communicating with said container opening, (2) a channel having a first sidewall and a second sidewall wherein said second sidewall is spaced from said first sidewall and said second sidewall is closer to said at least one dispensing orifice than is said first sidewall; and (3) a retention member in the form of a bead extending from said first sidewall toward said second sidewall over a portion of said channel;

a lid hinged to said body for accommodating lifting of said lid relative to said at least one dispensing orifice between (1) a closed position over said at least one dispensing orifice, and (2) an open position away from said at least one dispensing orifice, said lid having a top wall and a skirt;

an anchor member for being received in said channel and having an engaging portion in the form of a lip for engaging said retention member when said anchor member is received in said channel; and a plurality of spaced-apart frangible webs projecting outwardly from said skirt for initially connecting said anchor member with said lid for subsequently being broken when said lid is lifted from said closed position.

2. The closure system in accordance with claim 1 in which said channel opens upwardly and extends in an arcuate configuration less than 360° around said at least one dispensing orifice.

3. The closure system in accordance with claim 1 in which there are two of said channels.

4. The closure system in accordance with claim 1 in which said lip extends outwardly at the bottom of said anchor member.

5. The closure system in accordance with claim 1 in which said lid includes a pair of rearwardly extending lugs and a shaft that connects said lugs;

said body includes a bearing member defining an upwardly open channel for receiving said shaft to establish a hinged connection accommodating pivoting of said lid relative to said body between said closed and open positions.

6. The closure system in accordance with claim 1 in which said lid includes a front thumb lift tab;

said body and lid are hingedly connected at a location about 180 degrees from said lift tab; and said channel and anchor member are laterally offset from a line extending through said lift tab and hinged connection to accommodate access to said lift tab and to accommodate the operation of said hinged connection.

7. The closure system in accordance with claim 1 in which said closure system is a closure for an end of said container wherein the container end defines said container opening; and said closure includes said body, said lid, said anchor member, and said at least one frangible member.

8. The closure system in accordance with claim 7 in which said closure is an article that is separate from said container; and said body is attachable to said container end over said container opening.

9. The closure system in accordance with claim 7 in which said container includes a peripheral wall forming said end that defines said container opening; and said body extends radially inwardly from said peripheral wall over said container end opening as a unitary part of said container end to define said at least one dispensing aperture.

10. The closure system in accordance with claim 1 in which said body and said lid are separately molded components that are joined by a hinge structure accommodating pivoting of said lid relative to said body.

11. A tamper-evident dispensing closure system for a container that has an opening to the container interior, said dispensing closure system comprising:

a body capable of extending from said container at said opening as either a separate structure or as a unitary extension of said container, said body having (1) at least one dispensing orifice for communicating with said container opening, (2) a channel which opens upwardly and extends in an arcuate configuration less than 360° around said at least one dispensing orifice, and (3) a retention member projecting over a portion of said channel;

a lid for accommodating lifting of said lid relative to said at least one dispensing orifice between (1) a closed position over said at least one dispensing orifice, and (2) an open position away from said at least one dispensing orifice;

an anchor member for being received in said channel and having an engaging portion for engaging said retention member when said anchor member is received in said channel; and at least one frangible web that initially connects said anchor member with said lid and that can be broken when said lid is lifted from said closed position.

12. A tamper-evident dispensing closure system for a container that has an opening to the container interior, said dispensing closure system comprising:

a body capable of extending from said container at said opening as either a separate structure or as a unitary extension of said container, said body defining (1) at least one dispensing orifice for communicating with said container opening, (2) first and second channels, and (3) first and second retention members projecting over a portion of said first and second channels, respectively;

a lid for accommodating lifting of said lid relative to said at least one dispensing orifice between (1) a closed position over said at least one dispensing orifice, and (2) an open position away from said at least one dispensing orifice;

first and second anchor members for being received in said first and second channels, respectively, said first and second anchor members each having an engaging portion for engaging said first and second retention members, respectively, when said first and second anchor members are received in said first and second channels, respectively; and at least one frangible web that initially connects said anchor member with said lid and that can be broken when said lid is lifted from said closed position.

13. A tamper-evident dispensing closure system for a container that has an opening to the container interior, said dispensing closure system comprising:

a body capable of extending from said container at said opening as either a separate structure or as a unitary extension of said container, said body having (1) at least one dispensing orifice for communicating with said container opening, (2) a channel, and (3) a retention member projecting over a portion of said channel;

a lid for accommodating lifting of said lid relative to said at least one dispensing orifice between (1) a closed position over said at least one dispensing orifice, and (2) an open position away from said at least one dispensing orifice;

an anchor member for being received in said channel and having an engaging portion for engaging said retention member when said anchor member is received in said channel; and at least one frangible web that initially connects said anchor member with said lid and that can be broken when said lid is lifted from said closed position;

said channel having a first sidewall and a second sidewall;

said second sidewall being spaced from said first sidewall and being closer to said at least one dispensing orifice than is said first sidewall; and said retention member having the form of a bead extending from said first sidewall toward said second sidewall.

* * * * *